US010446962B2

(12) United States Patent
Horiuchi

(10) Patent No.: US 10,446,962 B2
(45) Date of Patent: Oct. 15, 2019

(54) FEMALE TERMINAL FITTING

(71) Applicant: Sumitomo Wiring Systems, Ltd., Yokkaichi, Mie (JP)

(72) Inventor: Kanji Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/099,221

(22) PCT Filed: May 2, 2017

(86) PCT No.: PCT/JP2017/017240
§ 371 (c)(1),
(2) Date: Nov. 6, 2018

(87) PCT Pub. No.: WO2017/199765
PCT Pub. Date: Nov. 23, 2017

(65) Prior Publication Data

US 2019/0199027 A1 Jun. 27, 2019

(30) Foreign Application Priority Data

May 18, 2016 (JP) ..... 2016-099535

(51) Int. Cl.
*H01R 13/11* (2006.01)
*H01R 13/10* (2006.01)
*H01R 13/115* (2006.01)

(52) U.S. Cl.
CPC ..... *H01R 13/11* (2013.01); *H01R 13/10* (2013.01); *H01R 13/115* (2013.01)

(58) Field of Classification Search
CPC ..... H01R 13/11
(Continued)

(56) References Cited

U.S. PATENT DOCUMENTS 3,228,207 A * 1/1966 Hartmann, Jr. ..... H01R 13/115 439/849
3,550,069 A * 12/1970 Teagno ..... H01R 13/115 439/849

(Continued)

FOREIGN PATENT DOCUMENTS

JP 56-56177 5/1981
JP 2001-210417 8/2001

(Continued)

OTHER PUBLICATIONS

International Search Report dated Aug. 1, 2017.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A female terminal fitting (1) includes a tubular portion (14) to receive a rod-like mating terminal (30). Three contact points are on an inner surface of the tubular portion and achieve point contact with an outer surface of the mating terminal (30). One or more resilient contact pieces (18) resiliently contact the mating terminal (30). The contact points (15) are disposed side by side in an outer circumferential direction of the mating terminal (30) when viewed along a center axis (31) of the mating terminal (30). The contact point in the middle is shifted along the center axis (31) with respect to the contact points on both sides in the outer circumferential direction. The resilient contact pieces (18) resiliently contact the mating terminal (30) between the contact points on both sides and the contact point in the middle in the direction of the center axis (31).

4 Claims, 5 Drawing Sheets

(58) Field of Classification Search
USPC ..... 439/852
See application file for complete search history.

(56) References Cited

U.S. PATENT DOCUMENTS

| | | | | | |
|---|---|---|---|---|---|
| 4,681,393 | A * | 7/1987 | Fukishima | H01R 13/057 | 439/851 |
| 4,721,484 | A * | 1/1988 | Sakamoto | H01R 13/113 | 439/842 |
| 4,734,064 | A * | 3/1988 | Knapp | H01R 43/16 | 439/852 |
| 5,188,545 | A * | 2/1993 | Hass | H01R 13/11 | 439/851 |
| 5,437,567 | A * | 8/1995 | Peterson | H01R 13/113 | 439/842 |
| 5,607,328 | A * | 3/1997 | Joly | H01R 13/11 | 439/851 |
| 5,681,190 | A * | 10/1997 | Childs | H01R 13/11 | 439/842 |
| 6,102,752 | A * | 8/2000 | Bommel | H01R 13/18 | 439/845 |
| 6,261,134 | B1 * | 7/2001 | Muzslay | H01R 43/16 | 29/857 |
| 6,918,798 | B2 * | 7/2005 | Patel | H01R 13/114 | 439/851 |
| 7,402,089 | B1 * | 7/2008 | Myer | H01R 13/11 | 439/877 |
| 9,017,113 | B2 * | 4/2015 | Haga | H01R 13/03 | 439/816 |
| 9,843,151 | B2 * | 12/2017 | Miyakawa | H01R 43/16 | |
| 9,966,683 | B2 * | 5/2018 | Sasaki | H01R 13/113 | |
| 10,008,800 | B2 * | 6/2018 | Inoue | H01R 13/11 | |
| 10,056,708 | B2 * | 8/2018 | Onuma | H01R 13/11 | |
| D840,942 | S * | 2/2019 | DeVito | D13/149 | |
| 2013/0109250 | A1 | 5/2013 | Haga | | |
| 2018/0019530 | A1 * | 1/2018 | Fu | H01R 12/707 | |

FOREIGN PATENT DOCUMENTS

| | | |
|---|---|---|
| JP | 2001-210418 | 8/2001 |
| JP | 2010-251214 | 11/2010 |
| JP | 2013-25988 | 2/2013 |
| JP | 2013-98088 | 5/2013 |
| WO | 2011/125727 | 10/2011 |

* cited by examiner

FEMALE TERMINAL FITTING

BACKGROUND

Field of the Invention

This specification relates to a female terminal fitting.

Related Art

Japanese Unexamined Patent Publication No. 2001-210417 discloses a female terminal fitting into which a mating terminal is to be inserted. Specifically, the terminal includes a box-shaped body and a resilient contact piece folded inwardly from the front edge of one surface of the body. The terminal is connected to a male terminal fitting by resiliently sandwiching the male terminal fitting between the resilient contact piece and a surface of the body facing the resilient contact piece.

Further, FIGS. 5(A) and 5(B) herein show a female terminal fitting into which a mating terminal is to be inserted and in which spring contact points 50 are disposed at equal intervals on a circumference to flow a large current and resiliently contact the outer peripheral surface of a rod-like mating terminal 51.

However, in the case of the above female terminal fitting in which the spring contact points 50 are disposed at equal intervals on the circumference, if a force F acts in a direction perpendicular to a center axis of the mating terminal 51 on a part 52 of the mating terminal 51 projecting out from the female terminal fitting (i.e. if the mating terminal is pried), there is a problem that the mating terminal 51 easily is inclined. If the mating terminal 51 is inclined, the contact points are shifted. If this is repeated, a contact failure may occur, such as due to the peeling of the plating of the spring contact points 50.

This specification addresses those problems.

SUMMARY

A female terminal fitting disclosed by this specification includes a tubular portion into which a rod-like mating terminal is to be inserted. Three contact points are provided on an inner wall surface of the tubular portion. The contact points are configured to be held in point contact with an outer peripheral surface of the mating terminal. One or more resilient contact pieces extend from the tubular portion and are folded in. The resilient contact piece is configured to contact the mating terminal resiliently. The three contact points and the one or more resilient contact pieces are disposed dividably on a side where the three contact points are disposed and on a side where the one or more resilient contact pieces are disposed by a virtual straight line perpendicular to a center axis of the mating terminal when viewed in a direction of the center axis when the mating terminal is inserted into the tubular portion. The three contact points are disposed side by side in an outer circumferential direction of the mating terminal when viewed in the direction of the center axis and the contact point in the middle is shifted in the direction of the center axis with respect to the contact points on both sides in the outer circumferential direction. Additionally, the one or more resilient contact pieces resiliently contact the mating terminal between the contact points on the both sides and the contact point in the middle in the direction of the center axis.

The disposition of the three contact points, as described above, makes the mating terminal less likely to be inclined as compared to the case where spring contact points are disposed on a circumference as before. Thus, the rod-like mating terminal is difficult to pry.

It is also possible to provide four or more contact points on the inner wall surface of the tubular portion. However, even if four or more contact points are provided, only three contact points close to the mating terminal actually are held in contact with the mating terminal in many cases. Thus, in the case of arranging the contact points such that the mating terminal contacts four or more contact points, the mating terminal may easily become shaky because the contact points other than the three is/are not in contact. As a result, the mating terminal may be pried easily.

In contrast, according to the above female terminal fitting, three contact points configured to be held in point contact with the mating terminal are provided and disposed as described above. Thus, the mating terminal is difficult to become shaky as compared to the case where four or more contact points are provided. Thus, the mating terminal is difficult to pry. Accordingly the above female terminal fitting improves prying difficulty of the rod-like mating terminal and, hence, suppresses a contact failure.

Further, the contact point in the middle may be shifted forward in an inserting direction of the mating terminal with respect to the contact points on both sides.

Accordingly, prying difficulty of the mating terminal can be improved more as compared to the case where the contact point in the middle is shifted rearward in the inserting direction of the mating terminal with respect to the contact points on both sides.

Further, the tubular portion may have a pentagonal shape, one contact point may be provided on each of inner wall surfaces of three consecutive side walls of the tubular portion, and one resilient contact piece may be provided on each of the remaining two side walls. Accordingly, a manufacturing process can be simplified as compared to the case where the tubular portion has a polygonal shape with six or more sides.

Accordingly, it is possible to improve prying difficulty of a rod-like mating terminal and, hence, suppress a contact failure.

DETAILED DESCRIPTION

Figure 2:
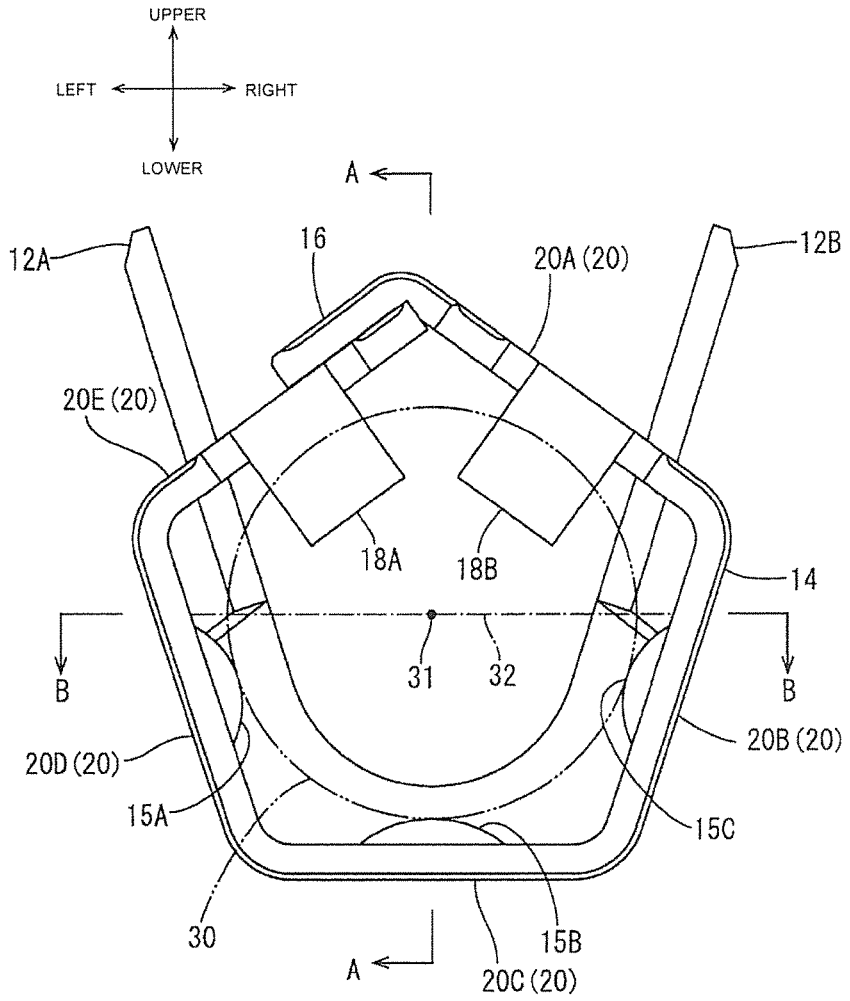
FIG. 2 is a front view of the female terminal fitting.
Figure 3:
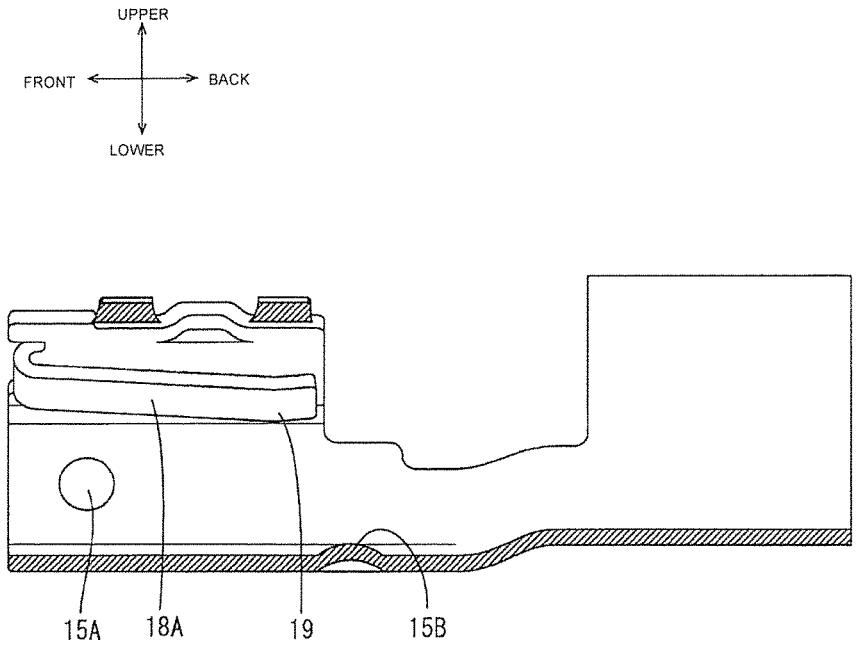
FIG. 3 is a section along A-A of FIG. 2.

An embodiment is described with reference to FIGS. 1 to 4. In the following description, a vertical direction and a lateral direction are based on a vertical direction and a lateral direction shown in FIG. 2 and a front-rear direction is based on a front-rear direction shown in FIG. 3. Further, a direction from front to rear in FIG. 3 is referred as a forward direction along an inserting direction of a mating terminal.

(1) Overall Configuration of Female Terminal Fitting

Figure 1:
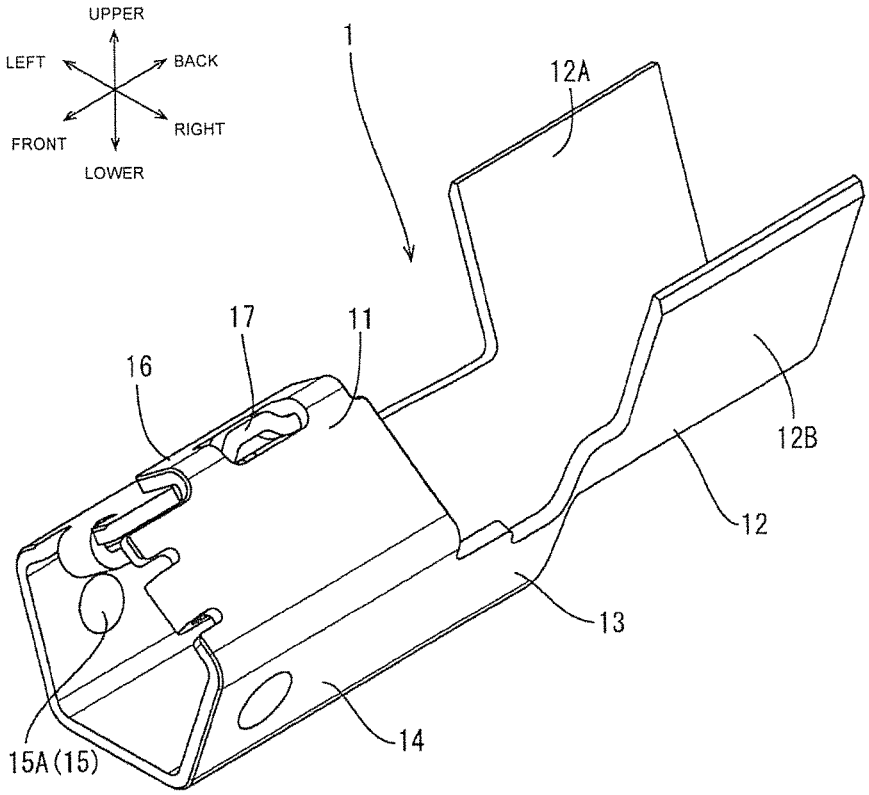
FIG. 1 is a perspective view of a female terminal fitting according to an embodiment.

First, a female terminal fitting 1 according to this embodiment is outlined with reference to FIG. 1. The female terminal fitting 1 is a large-current terminal used, such as for a power supply wire of an electric vehicle, a hybrid vehicle or the like, and is formed such that a body 11 into which a cylindrical or hollow cylindrical mating terminal 30 (see FIG. 2) is to be inserted and a wire connecting portion 12 are connected one after the other via a locking piece 13. The mating terminal 30 is an example of a rod-like mating terminal.

The body 11 includes a polygonal tube 14 (see FIGS. 1 and 4) having a pentagonal shape. Three embossments 15A to 15C (see FIGS. 2 to 4) are provided on the inner wall surface of the polygonal tube 14 and two resilient contact pieces 18A and 18B (see FIGS. 2 and 3) are provided in the polygonal tube 14. The polygonal tube 14 is an example of a tubular portion and the embossments 15A to 15C are an example of three contact points.

The polygonal tube 14 is formed by bending a metal plate stamped into a shape corresponding to the female terminal fitting 1. As shown in FIGS. 1 and 2, a locking piece 16 extends in a bending direction from one end of the polygonal tube 14 in the bending direction. As shown in FIG. 1, an opening is formed in the locking piece 16, whereas a locking protrusion 17 projects out on the other end of the polygonal tube 14 in the bending direction by cutting and raising. The polygonal tube 14 is prevented from being opened by bending the locking piece 16 and locking an opening edge of the locking piece 16 to the locking protrusion 17 after the polygonal tube 14 is bent into a pentagonal tube shape.

As shown in FIG. 2, five side walls 20 constituting the polygonal tube 14 are referred to respectively as a first side wall 20A, a second side wall 20B, a third side wall 20C, a fourth side wall 20D and a fifth side wall 20E in a clockwise order from the side wall on the one side described above.

As shown in FIG. 2, the embossments 15 are contact points to be held in point contact with the outer peripheral surface of the mating terminal 30, and one embossment 15 is provided on each of the inner wall surfaces of three side walls (i.e. second side wall 20B, third side wall 20C and fourth side wall 20D) excluding the side walls 20A and 20E on both sides in the aforementioned bending direction of the five side walls 20. These embossments 15 are formed by striking and have a spherical surface. Further, plating is applied to these embossments 15.

The two resilient contact pieces 18A, 18B are for pressing the mating terminal 30 into contact with the three embossments 15, and are provided on the first side wall 20A and the fifth side wall 20E provided with no embossments 15 out of the five side walls 20. As shown in FIG. 3, the resilient contact piece 18A is a leaf spring formed by folding a tongue extending forward from a front opening edge of the side wall 20E inward of the polygonal tube 14 into a U shape, and an inwardly folded part obliquely extends in toward a rear side, and a tip part thereof is bent to extend obliquely out. A bent part 19 bulging most inward in the resilient contact piece 18A serves as a contact point to be held in contact with the mating terminal 30. The same also applies to the resilient contact piece 18B.

As shown in FIG. 2, each of the two resilient contact pieces 18A, 18B is configured to press the mating terminal 30 toward a corner between two side walls 20 on an opposite side across the mating terminal 30. For example, in the case of the resilient contact piece 18A, two side walls 20 on the opposite side across the mating terminal 30 are the second side wall 20B and the third side wall 20C, and the resilient contact piece 18A presses the mating terminal 30 toward the corner between the second and third side walls 20B, 20C. The same also applies to the resilient contact piece 18B.

As shown in FIG. 1, the link 13 extends rearward from the rear end edges of the three side walls 20B to 20D of the polygonal tube 14 formed with the embossments 15. The wire connecting portion 12 extends rearward from the rear end edge of the link 13, and is formed integrally with barrels 12A and 12B to be crimped to a core of a wire.

(2) Arrangement of Embosses and Resilient Contact Pieces

Next, the arrangement of the three embossments 15 and the two resilient contact pieces 18 described above is described with reference to FIGS. 2 to 4.

As shown in FIG. 2, each of the three embossments 15 is provided on a corresponding one of the three consecutive side walls 20B to 20D of the polygonal tube 14, and the embossments 15 are arranged in an outer circumferential direction of the mating terminal 30 when viewed in a direction of a center axis 31 of the mating terminal 30 when the mating terminal 30 is inserted into the polygonal tube 14. In other words, the three embossments 15 are arranged on a circumference centering on the center axis 31 of the mating terminal 30. Thus, each of the three embossments 15 can contact the outer peripheral surface of the mating terminal 30.

The embossments 15A and 15C correspond to embossments on both sides in the outer circumferential direction of the mating terminal 30 when viewed in the direction of the center axis 31 of the mating terminal 30, and the embossment 15B corresponds to an embossment located between the former embossments.

Figure 4:
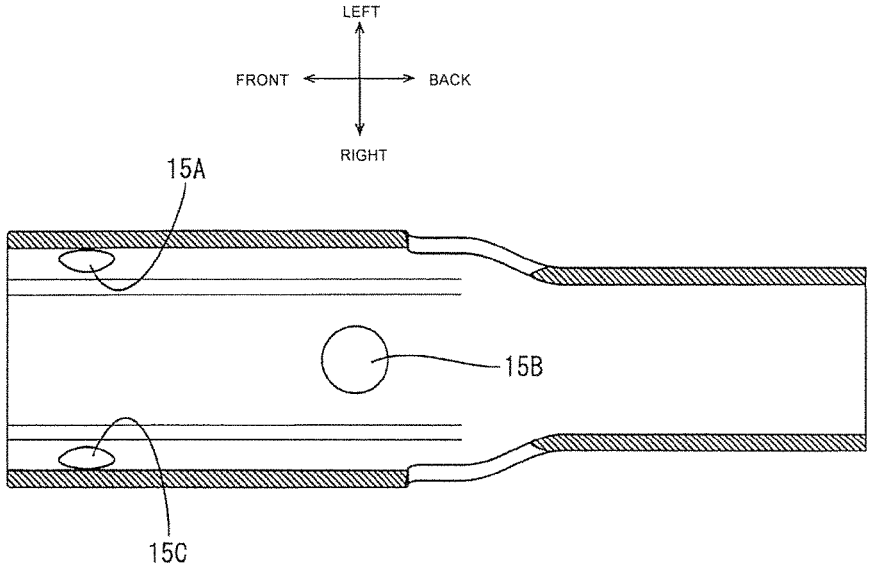
FIG. 4 is a section along B-B of FIG. 2.
Figure 5A:
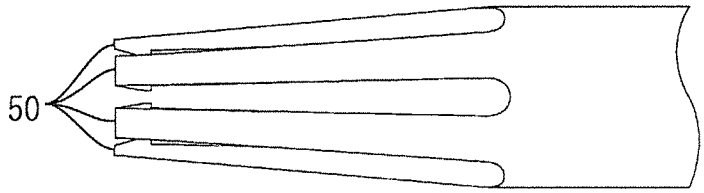
FIG. 5(A) is a side view of a conventional female terminal fitting and FIG. 5(B) is a section of the conventional female terminal fitting in a state where a rod-like mating terminal is inserted.
Figure 5B:
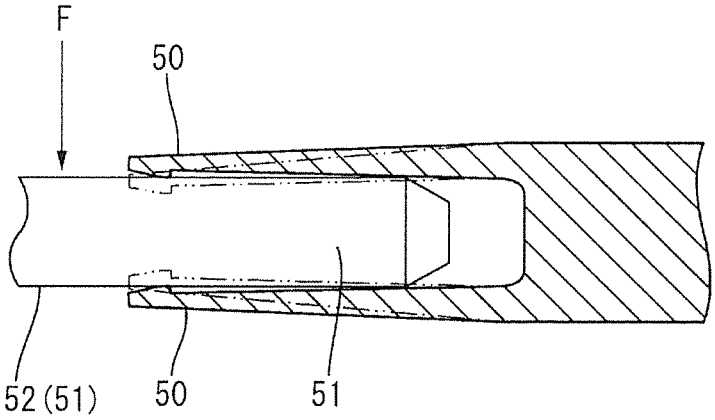

As shown in FIGS. 3 and 4, the embossment 15B in the middle is shifted forward in the inserting direction of the mating terminal 30 with respect to the embossments 15A and 15C on both sides. More specifically, an interval in the front-rear direction between the embossment 15B in the middle and the embossment 15A, 15C on the both sides is longer than an interval in the lateral direction between the embossments 15A, 15C on the both sides.

Further, as shown in FIG. 2, out of the three embossments 15 and the two resilient contact pieces 18, the three embossments 15 are disposed on one side of a virtual straight line 32 perpendicular to the center axis 31 of the mating terminal 30 and the two resilient contact pieces 18 are disposed on the other side. Specifically, the three embossments 15 and the two resilient contact pieces 18 are disposed dividably on the side where the three embossments 15 are disposed and on the side where the two resilient contact pieces 18 are disposed by the virtual straight line 32 perpendicular to the center axis 31 when viewed in the direction of the center axis 31 of the mating terminal 30. Thus, the mating terminal 30 is pressed toward the three embossments 15 by the two resilient contact pieces 18.

Further, as shown in FIG. 3, the bent part 19 of each resilient contact piece 18 to be held in contact with the mating terminal 30 is located between the embossments 15A, 15C on the both sides and the embossment 15B in the middle in the front-rear direction. Thus, the mating terminal 30 pressed by each resilient contact piece 18 is pressed into contact with each of the two embossments 15A, 15C on both sides and the embossment 15B in the middle.

(3) Effects of Embodiment

According to the female terminal fitting 1 described above, the three embossments 15 are disposed side by side in the outer circumferential direction of the mating terminal 30 and the embossment 15B in the middle is shifted forward in the inserting direction of the mating terminal 30 with respect to the embossments 15A, 15C on both sides in the outer circumferential direction. Thus, as compared to the case where spring contact points are disposed on a circumference as before, the mating terminal 30 is less likely to be inclined. Therefore, the cylindrical or hollow cylindrical mating terminal 30 is difficult to pry.

It is also possible to provide four or more embossments 15 on the inner wall surface of the polygonal tube 14. However, even if four or more embossments 15 are provided, only three embossments 15 close to the mating terminal 30 actually are held in contact with the mating terminal 30 in many cases. Thus, in the case of arranging the embossments 15 such that the mating terminal 30 is in contact with four or more embossments 15, the mating terminal 30 may easily become shaky because the embossment 15 other than the three is/are not in contact. As a result, the mating terminal 30 may be pried easily.

In contrast, according to the female terminal fitting 1, three embossments 15 are provided and disposed as described above. Thus, the mating terminal 30 is less likely to become off-balance and is difficult to become shaky as compared to the case where four or more embossments 15 are provided. Thus, the mating terminal 30 is difficult to pry.

Thus, according to the female terminal fitting 1, it is possible to improve prying difficulty of the cylindrical or hollow cylindrical mating terminal 30 and, hence, suppress a contact failure.

According to the female terminal fitting 1, the embossment 15B in the middle is shifted forward in the inserting direction of the mating terminal 30 with respect to the embossments 15A, 15C on the both sides. Thus, prying difficulty of the mating terminal 30 can be more improved as compared to the case where the embossment 15B in the middle is shifted rearward in the inserting direction of the mating terminal 30 with respect to the embossments 15A, 15C on the both sides.

The polygonal tube 14 has a pentagonal shape according to the female terminal fitting 1. Thus, a manufacturing process can be simplified as compared to the case where the polygonal tube 14 has a polygonal shape with six or more sides.

The invention is not limited to the above described and illustrated embodiment. For example, the following embodiments also are included in a technical scope disclosed by this specification.

A case where the tubular portion has a pentagonal shape is described as an example in the above embodiment. However, the shape of the tubular portion is not limited to the pentagonal shape and may be a hexagonal shape.

In the case of a hexagonal shape, one embossment 15 may be provided on each of three consecutive side walls and one resilient contact piece 18 may be provided on each of three side walls provided with no embossment 15. Alternatively, the resilient contact piece 18 may not be provided on the side wall in the middle out of the three side walls provided with no embossment 15. Alternatively, the resilient contact piece 18 may be provided only on the side wall in the middle out of the three side walls provided with no emboss 15 and no resilient contact piece 18 may be provided on each of the side walls on both sides.

A case where the tubular portion is a polygonal tube is described in the above embodiment. In contrast, the tubular portion may be a cylindrical tube.

A case where the embossment 15B in the middle is shifted forward in the inserting direction of the mating terminal 30 with respect to the embossments 15A, 15C on the both sides is described as an example in the above embodiment. However, the embossment 15B in the middle may be shifted rearward in the inserting direction of the mating terminal 30 with respect to the embossments 15A, 15C on both sides.

A case where the mating terminal has a cylindrical or hollow cylindrical shape is described in the above embodiment. However, the mating terminal may have a pentagonal cross-section or the like.

LIST OF REFERENCE SIGNS

1 . . . female terminal fitting,
14 . . . polygonal tube (example of tubular portion),
15A to 15C . . . embossment (example of contact point portion),
18A, 18B . . . resilient contact piece,
20A to 20E . . . side wall,
30 . . . mating terminal,
31 . . . center axis,
32 . . . virtual straight line

The invention claimed is:

1. A female terminal fitting, comprising:

a tubular portion into which a rod-like mating terminal is to be inserted;

three contact point provided on an inner wall surface of the tubular portion, the contact point being configured to be held in point contact with an outer peripheral surface of the mating terminal; and one or more resilient contact pieces extending from the tubular portion and folded inward, the resilient contact piece being configured to resiliently contact the mating terminal;

wherein:

the three contact point and the one or more resilient contact pieces are disposed dividably on a side where the three contact point are disposed and on a side where the one or more resilient contact pieces are disposed by a virtual straight line perpendicular to a center axis of the mating terminal when viewed in a direction of the center axis when the mating terminal is inserted into the tubular portion;

the three contact point are disposed side by side in an outer circumferential direction of the mating terminal when viewed in the direction of the center axis and the contact point in the middle is shifted in the direction of the center axis with respect to the contact point on both sides in the outer circumferential direction; and the one or more resilient contact pieces resiliently contact the mating terminal between the contact point on both sides and the contact point in the middle in the direction of the center axis.

2. The female terminal fitting of claim 1, wherein the contact point in the middle is shifted forward in an inserting direction of the mating terminal with respect to the contact point on the both sides.

3. The female terminal fitting of claim 2, wherein the tubular portion has a pentagonal shape, one contact point is provided on each of inner wall surfaces of three consecutive side walls of the tubular portion, and one resilient contact piece is provided on each of the remaining two side walls.

4. The female terminal fitting of claim 1, wherein the tubular portion has a pentagonal shape, one contact point is provided on each of inner wall surfaces of three consecutive side walls of the tubular portion, and one resilient contact piece is provided on each of the remaining two side walls.

* * * * *